United States Patent [19]

Hoagland

[11] 4,334,555

[45] Jun. 15, 1982

[54] CURLING EYE HEDDLE

[75] Inventor: Carolyn S. Hoagland, Ames, Iowa

[73] Assignee: Iowa State University Research Foundation, Inc., Ames, Iowa

[21] Appl. No.: 176,352

[22] Filed: Aug. 8, 1980

[51] Int. Cl.[3] ..... D03C 9/04

[52] U.S. Cl. ..... 139/95

[58] Field of Search ..... 139/29, 30, 33, 48, 139/49, 50, 52, 93, 94, 95, 96

[56] References Cited

U.S. PATENT DOCUMENTS

| | | | |
|---|---|---|---|
| 613,392 | 11/1898 | Patterson | 139/52 |
| 658,961 | 10/1900 | Runge | 139/95 |
| 1,006,563 | 10/1911 | Kelmel | 139/52 |
| 1,014,771 | 1/1912 | Parks | 139/95 |
| 1,517,129 | 11/1924 | Ruegg | 139/93 |
| 2,150,843 | 3/1939 | Raba et al. | 139/93 |
| 2,242,210 | 5/1941 | Gallinger | 139/93 |
| 2,249,390 | 7/1941 | Mahler | 139/93 |
| 2,462,581 | 2/1949 | Watson | 139/93 |

FOREIGN PATENT DOCUMENTS

| | | | |
|---|---|---|---|
| 921476 | 1/1947 | France | 139/29 |
| 2379628 | 10/1978 | France | 139/29 |

*Primary Examiner*—Henry Jaudon

*Attorney, Agent, or Firm*—Zarley, McKee, Thomte, Voorhees & Sease

[57] ABSTRACT

The curling eye heddle of the present invention utilizes a curling eye which permits the warp thread used in weaving to be threaded onto or unthreaded off of the heddle at the level of the sheet of warps. The curling eye heddle also permits individual warp threads to be lifted or depressed above or below the sheet of warps, respectively. A diamond adjacent to the curling eye prevents the curling eye from catching or snagging neighboring warp threads.

10 Claims, 6 Drawing Figures

CURLING EYE HEDDLE

BACKGROUND OF THE INVENTION

A conventional heddle used in weaving on a loom typically has a central hole of some form located at the midpoint of the heddle. The warp thread is passed through the hole and is wound on spools at both ends of the loom. One problem with a conventional heddle is that once the thread is passed through the hole and weaving has begun, the thread cannot be removed in any easy manner to change the design of the weave. Some prior heddle designs provide means for "self threading", in other words, introducing the warp threads onto the heddle without cutting the warp threads. Some of these self threading heddles require the individual warp be raised or lowered above or below the level of the sheet of warps in order to be threaded or unthreaded onto or off of the heddle. In order to raise or lower the warp, the loom tension must be relaxed to provide several inches of slack. Besides the time it takes to loosen and readjust the loom tension, when the warps are slack they are no longer held side by side in an orderly position. This causes confusion in the process of rethreading the warp threads in a new arrangement and provides a greater chance of the warp threads becoming entangled in each other.

Also, none of the self-threading heddles that can both lift and depress the warps are in any way detachable from the heddle frames once the loom is threaded and the weaving begun.

Other self threading heddles permit the warp to be threaded or unthreaded at the level of the sheet of warps, but none of these allow both the lifting and depressing of the warp threads.

The curling eye heddle of the present invention overcomes these problems by using a curling eye as the central hole from which the warp thread may be threaded or unthreaded at the level of the sheet of warps and which permits the individual warps to be lifted or depressed above or below the sheet of warps.

Therefore, it is a primary object of the present invention to provide a heddle with a curling eye for threading and unthreading the warp thread at the level of the sheet of warps onto and off of the heddle.

A further object of the present invention is to provide a heddle that can lift or depress individual warps above or below the sheet of warps, respectively.

A further object of the present invention is to provide a heddle which can be easily removed from the lower heddle frame.

A further object of the present invention is the provision of a heddle which is economical to manufacture, durable in use, and efficient in operation.

SUMMARY OF THE INVENTION

The present invention utilizes a curling eye that is designed so as to provide a means of threading and unthreading warp thread onto and off of a heddle used in weaving done on a loom. This allows the weave design to be changed at various times throughout the weaving process. A diamond located adjacent to the curling eye prevents the eye from catching or snagging neighboring threads when the heddle lifts or depresses individual warps above or below the sheet of warps, respectively. The heddle has a loop at each end which the hedde frame passes through. Two modifications of the present invention provide a loop which may be easily removed from the lower heddle frame, thus allowing a change in the pattern of the weave at various times throughout the weaving process.

DETAILED DESCRIPTION OF THE INVENTION

Figure 1:
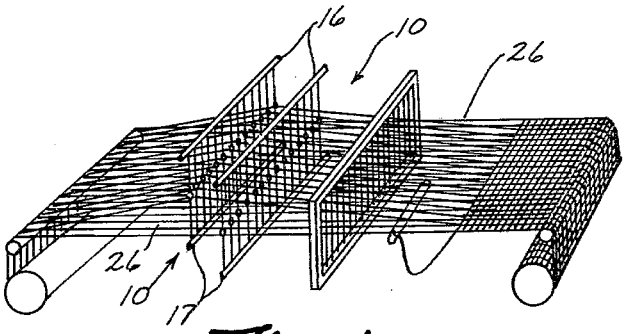
FIG. 1 is a sketch of a weaving loom.

Referring to the drawings, the numeral 10 generally designates the curling eye heddle. At each end of the heddle there is an end loop 12 formed by twisting the wire and thus forming a helix 14 at the base of each end loop. The end loops 12 encompass the upper heddle frame 16 and the lower heddle frame 17.

The wire is twisted into a helix 20 at the top of the diamond-shaped guard 18 and the wire is wrapped around the base 22 of the guard 18 to form a short helix. The wire is then brought upward and turned approximately one and one half turns to form the curling eye 24.

Figure 4:
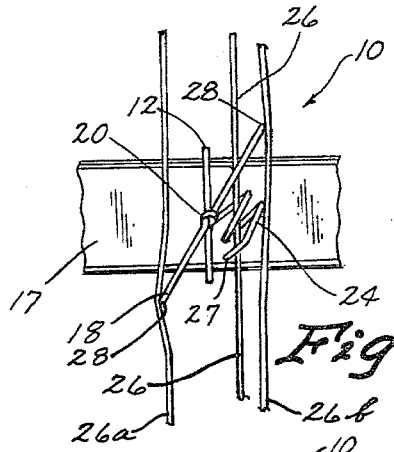
FIG. 4 is a view taken along line 4—4 of FIG. 2 of the curling eye heddle.
Figure 2:
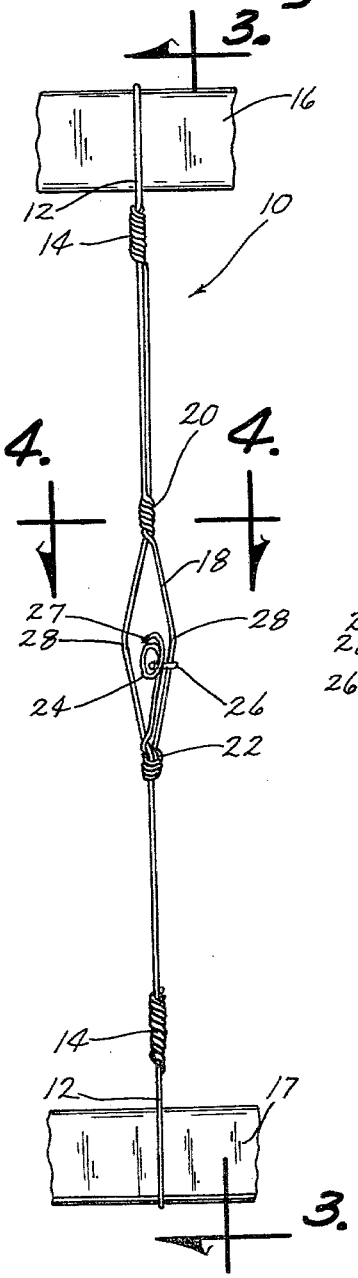
FIG 2 is a side view of the curling eye heddle.
Figure 3:
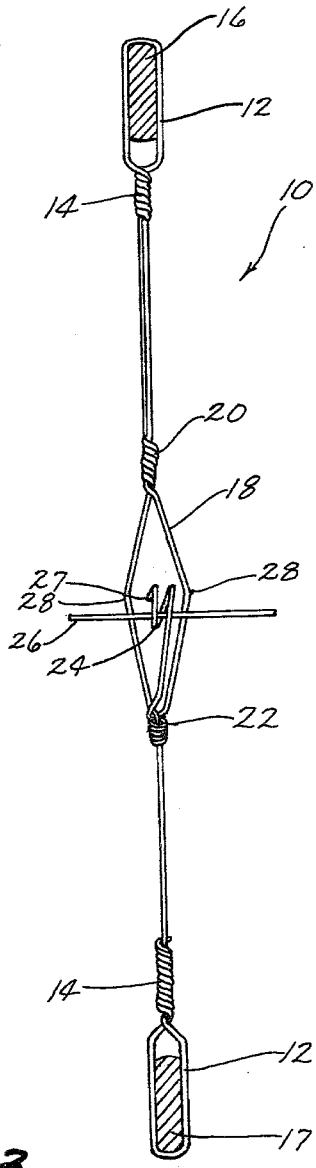
FIG. 3 is a view taken along line 3—3 of FIG. 2.

The warp thread 26 passes through the curling eye 24 at a level slightly lower than that in which a horizontal plane passes through the obtuse angles 28 of the guard 18. The warp thread 26 does not pass through the guard but passes around one of the angles 28, as shown in FIG. 4. The guard 28, having an angular displacement with respect to the common vertical plane of the end loops, serves to spread adjacent warp threads **26*a* and 26*b* when the heddle is lifted or depressed, thus preventing the wire end 27 in the curling eye 24** from catching or snagging the adjacent threads.

Figure 5:
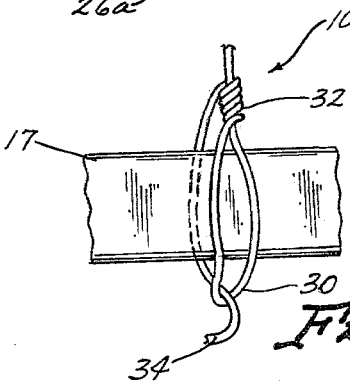
FIG. 5 shows a modification of the end loop.

Referring to FIG. 5, a removable loop 30 is provided so that the heddle 10 can be removed from the lower heddle frame 17. In this configuration, the loop 30 is formed by twisting the wire into a helix 32 at the top of the loop. Both sides of the loop are on one side of the lower heddle frame 17. The free end 34 of the wire is passed on the opposite side of the heddle frame and threaded through the loop 30 to secure the loop to the heddle frame. To remove the loop from the lower heddle frame 17, the free end 34 simply needs to be pulled out of the loop 30.

Figure 6:
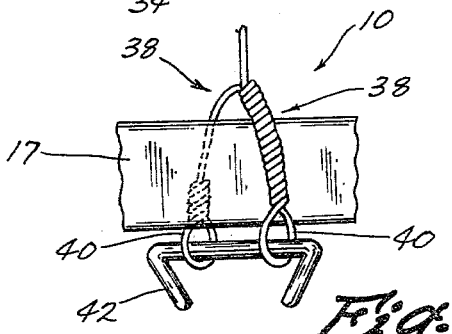
FIG. 6 shows a second modification of the end loop.

Referring to FIG. 6, a removable end 38 is provided by forming two small loops 40 from the wire. The two small loops 40 pass on either side of the lower heddle frame 17 and a fastener 42 is passed through the small loops 40 to operatively secure the curling eye heddle 10 to the lower heddle frame 17. The heddle can easily be removed from the lower heddle frame by simply taking out the fastener 42.

The thread 26 is threaded onto the curling eye 24 from the right side by bringing the thread down from the top side of the curling eye next to the guard 18 until the thread is near the base 22 of the guard. The forward end of the thread is then placed over the wire end 27 so that the thread now passes through the curling eye. The curling eye completely surrounds the warp thread, thus permitting the thread to be lifted or depressed. When the thread is lifted or depressed, the guard 18 spreads apart adjacent threads **26*a* and 26*b* and prevents the wire end 27** from snagging or catching the neighboring threads.

The thread can be removed from the heddle curling eye by reversing the threading process. The ability to lift and depress the warp threads, along with the ability to remove the thread from the heddle curling eye, plus the possibility of completely removing the heddle from the lower heddle frame, makes it simple and easy to change the weave design and pattern at any stage of the weaving process.

The curling eye heddle is preferably constructed from one continuous piece of wire, but more than one piece of wire could be used to construct the curling eye heddle. The heddle can be made of metal or suitable plastic.

Therefore, it can be seen that the present invention accomplishes at least all of its stated objectives.

What is claimed is:

1. A curling eye heddle for use on a weaving loom with spaced apart upper and lower heddle frames, said heddle comprising:

an elongated member having opposite longitudinal end loops for surrounding said upper and lower heddle frames; said end loops being in a common vertical plane;

a curling eye formed in said heddle intermediate said opposite ends thereof, said curling eye comprising a helically coiled member having a horizontal axial central axis extending obliquely with respect to said common vertical plane of said loops; and further having opposite sides;

guard means located adjacent said curling eye, said guard means having opposite side members extending laterally outwardly beyond the opposite sides of said curling eye to prevent said wire end from catching or snagging adjacent warp threads.

2. A heddle according to claim 1 wherein each said end loop has a helix twist at one end, thus preventing said end loop from becoming dimensionally smaller or larger due to wire slippage.

3. A heddle according to claim 1 wherein said curling eye is formed from one and one-half turns of one end of a wire in such a manner so as to allow a warp thread to be threaded and unthreaded onto and off of said curling eye.

4. A heddle according to claim 1 wherein said loops, curling eye, and guard member are formed from a continuous piece of wire.

5. A heddle according to claim 1 wherein said lower loop is detachably connected to said lower heddle frame.

6. A heddle according to claim 5 wherein said loops each comprise a Y-shaped member having Y-arm members embracing the opposite sides of said lower heddle frame, detachable clip means interconnecting said Y-arm members for detachably securing said loop to said lower heddle frame.

7. A heddle according to claim 1 wherein said curling eye is located with respect to said guard member so that the axis of said curling eye is at a lower horizontal level than that of said side members of said guard member.

8. A heddle according to claim 7 wherein said guard member comprises a diamond shaped member having opposite side angles formed thereon, said side angles forming said side members.

9. A heddle according to claim 1 wherein said curling eye includes at least one and one-half helical revolutions so as to permit said warp thread to be easily inserted and removed from said curling eye at the level of the sheets of warps and so as to permit said warp thread to be lifted and depressed above and below said sheet of warp, respectively.

10. A heddle according to claim 8 wherein said guard member lies in a plane perpendicular to that of said curling eye axis and having one edge extending sufficiently laterally beyond said vertical plane of said loops so as to prevent said wire end of said curling eye from catching or snagging adjacent warp threads.

* * * * *